US006871778B2

(12) United States Patent
Petrelli et al.

(10) Patent No.: US 6,871,778 B2
(45) Date of Patent: Mar. 29, 2005

(54) CONTAINER FOR HOLDING AND DISPENSING MULTIPLE TYPES OF ITEMS

(75) Inventors: J. Anthony Petrelli, Highland Heights, OH (US); Daniel J. Nelson, Chagrin Falls, OH (US)

(73) Assignee: Caraustar Custom Packaging, Grand Rapids, MI (US)

( * ) Notice: Subject to any disclaimer, the term of this patent is extended or adjusted under 35 U.S.C. 154(b) by 185 days.

(21) Appl. No.: 10/408,462

(22) Filed: Apr. 7, 2003

(65) Prior Publication Data

US 2004/0195299 A1 Oct. 7, 2004

(51) Int. Cl.[7] ..... B65D 5/486; B65D 5/54

(52) U.S. Cl. ..... 229/120.18; 229/121; 229/122; 229/122.1; 229/242; 493/162; 493/912

(58) Field of Search ..... 229/120.03, 120.11, 229/120.18, 121, 122, 122.1, 240, 242; 206/703, 705; 221/305; 493/162, 167, 169–174, 177–182, 912

(56) References Cited

U.S. PATENT DOCUMENTS

| | | | | |
|---|---|---|---|---|
| 887,729 A | | 5/1908 | Kirmse | |
| 900,953 A | | 10/1908 | Reber | |
| 901,286 A | | 10/1908 | Ferres et al. | |
| 1,430,149 A | | 9/1922 | Bliss | |
| 1,628,439 A | * | 5/1927 | Staubly | 221/305 |
| 1,995,286 A | | 3/1935 | Arzet | |
| 1,998,717 A | | 4/1935 | Guyer | |
| 2,011,438 A | | 8/1935 | Daller | |
| 2,299,027 A | * | 10/1942 | Novak | 229/122.1 |
| 2,348,377 A | | 5/1944 | Goodyear | |
| 2,367,476 A | | 1/1945 | Tyrseck | |
| 2,369,387 A | | 2/1945 | Williamson et al. | |
| 2,369,392 A | | 2/1945 | Ringler | |
| 2,385,400 A | * | 9/1945 | Briggs | 206/705 |
| 2,396,310 A | | 3/1946 | Yungblut | |
| 2,403,698 A | | 7/1946 | Williamson et al. | |
| 2,502,117 A | | 3/1950 | Anderson | |
| 2,717,074 A | | 9/1955 | Williamson et al. | |
| 2,766,923 A | | 10/1956 | D'Esposito | |
| 2,794,588 A | | 6/1957 | George et al. | |
| 2,836,343 A | | 5/1958 | Will | |
| 2,848,153 A | | 8/1958 | Geiger, Sr. | |
| 2,872,855 A | | 2/1959 | Fahrenkrug | |
| 2,881,967 A | | 4/1959 | Ringler | |
| 2,939,621 A | | 6/1960 | Mittleman | |
| 2,951,627 A | | 9/1960 | Wenzel | |
| 2,983,424 A | | 5/1961 | Glass | |
| 3,008,569 A | | 11/1961 | Murch | |
| 3,023,679 A | | 3/1962 | Piazze | |
| 3,085,736 A | | 4/1963 | Meyers | |
| 3,115,290 A | * | 12/1963 | Byassee | 229/120.18 |

(List continued on next page.)

FOREIGN PATENT DOCUMENTS

| | | | |
|---|---|---|---|
| CA | 1017728 | 9/1977 | |
| CA | 1323608 | 10/1993 | H05B/6/64 |
| DE | 2002995 | 7/1971 | |
| DE | 2046484 | 3/1972 | |
| DE | 3140389 A1 | 6/1983 | B65D/5/54 |
| GB | 2229996 A | 10/1990 | B65D/5/54 |
| JP | 5-97151 | 4/1993 | B65D/33/25 |

*Primary Examiner*—Gary E. Elkins
(74) *Attorney, Agent, or Firm*—Summa & Allan, P.A.

(57) ABSTRACT

A container is provided with a main cavity partitioned into several compartments by dividing walls bridging the main cavity. The container and dividing walls are constructed by providing a single blank and forming the container out of the blank using folds and attachments. The compartments are adapted for holding and dispensing objects having different characteristics from each other, including different dimensions. Under the present invention, a single container allows for customized dispensing means for several types of items.

20 Claims, 3 Drawing Sheets

U.S. PATENT DOCUMENTS 3,140,809 A 7/1964 Hickin et al.
3,161,346 A 12/1964 Svensson
3,168,974 A 2/1965 Buttery et al.
3,172,563 A 3/1965 Harwood
3,197,114 A 7/1965 Holmes
3,197,115 A 7/1965 Peter
3,198,420 A 8/1965 Hiersteiner
3,207,416 A 9/1965 Koltz et al.
3,249,283 A 5/1966 Craddock et al.
3,295,743 A 1/1967 Redpath et al.
3,300,115 A * 1/1967 Schauer ..... 221/305
3,321,354 A 5/1967 Sloan et al.
3,322,264 A 5/1967 NcNair et al. ..... 206/45.25
3,332,594 A * 7/1967 De Capua ..... 221/309
3,345,918 A 10/1967 Simeone
3,355,995 A 12/1967 Borkmann et al.
RE26,371 E 4/1968 Schultz
3,385,428 A 5/1968 Kugler
3,432,090 A 3/1969 Engel
3,434,849 A 3/1969 Carbone
3,465,944 A 9/1969 Robinson ..... 229/5.5
3,514,032 A 5/1970 Pierce
3,524,581 A 8/1970 Buttery
3,537,360 A 11/1970 Farnam
3,708,108 A 1/1973 Rosenburg, Jr.
3,710,396 A 1/1973 Tomlinson ..... 2/197
3,727,827 A 4/1973 Stice
3,744,702 A 7/1973 Ellison
3,756,501 A 9/1973 Skillen et al.
3,774,838 A 11/1973 Christie
3,907,194 A 9/1975 Davenport et al.
3,910,486 A 10/1975 Stone
3,961,743 A 6/1976 Hollowell
3,963,173 A 6/1976 Stone
4,042,164 A 8/1977 Croley
4,048,052 A 9/1977 Tolaas
4,083,455 A 4/1978 Keating, Jr.
4,102,457 A 7/1978 Meyers
4,127,229 A 11/1978 Roccaforte
4,136,816 A 1/1979 Gardner
4,141,449 A 2/1979 Stone
4,284,193 A 8/1981 Roccaforte ..... 206/45.31
4,289,239 A 9/1981 Meyers
4,314,643 A 2/1982 Forbes, Jr.
4,493,453 A * 1/1985 LeDrew ..... 229/120.18
4,531,669 A 7/1985 Osborne
4,542,847 A 9/1985 Lindstrom
4,679,694 A 7/1987 Donohie et al.
4,688,677 A 8/1987 Roccaforte
4,726,471 A 2/1988 Whately et al. ..... 206/554
4,732,315 A 3/1988 Gunn ..... 229/125.09
4,742,917 A * 5/1988 Bornwasser et al. ... 229/120.03
4,747,536 A 5/1988 Wischusen, III ..... 229/128
4,768,703 A 9/1988 Sosler et al. ..... 229/123.1
4,773,542 A 9/1988 Schillinger et al.
4,871,345 A 10/1989 Wosaba, II et al. ..... 493/59
4,948,038 A 8/1990 Moeller ..... 229/146
4,981,256 A 1/1991 Giblin et al. ..... 229/125.09
4,986,420 A 1/1991 Gunn et al.
4,997,087 A 3/1991 Lorenz
5,014,905 A 5/1991 Cassidy ..... 229/113
5,036,982 A 8/1991 Aston
5,054,644 A 10/1991 Greenslade
5,064,072 A * 11/1991 Nakamura ..... 229/120.03
5,092,516 A 3/1992 Kastanek ..... 229/226
5,129,875 A 7/1992 Chaygneaud-Dupuy ..... 493/335
5,135,158 A * 8/1992 Boyle et al. ..... 229/120.03
5,148,973 A 9/1992 Zimmermann ..... 229/125.28
5,154,343 A 10/1992 Stone ..... 229/225
5,161,733 A 11/1992 Latif ..... 229/225
5,161,734 A 11/1992 Ruehl et al. ..... 229/227
5,167,324 A * 12/1992 Miller ..... 229/242
5,170,934 A 12/1992 Lemoine ..... 229/101
5,215,248 A 6/1993 Moser
5,219,089 A 6/1993 Kiolbasa et al.
5,236,123 A 8/1993 Stone et al. ..... 229/225
5,238,179 A 8/1993 Hart ..... 229/117.13
5,249,681 A 10/1993 Miller ..... 206/427
5,265,799 A 11/1993 Stone ..... 229/225
5,277,360 A 1/1994 DeMott ..... 229/122
5,314,114 A 5/1994 Stone ..... 229/225
5,320,279 A 6/1994 Giblin et al. ..... 229/225
5,322,215 A 6/1994 Roccaforte ..... 229/225
5,325,989 A 7/1994 Karalus
5,328,091 A 7/1994 Koss ..... 229/231
5,363,981 A 11/1994 Giblin et al.
5,373,960 A 12/1994 Gunn et al.
5,439,133 A 8/1995 Stone
5,443,205 A 8/1995 Robotham et al. ..... 229/243
5,505,374 A 4/1996 Stone ..... 229/227
5,515,996 A 5/1996 Stone
5,551,938 A 9/1996 Stone ..... 493/96
5,553,773 A 9/1996 Focke et al. ..... 229/224
5,624,031 A 4/1997 Fowler et al. ..... 206/391
5,673,849 A 10/1997 Stone ..... 229/227
5,725,144 A 3/1998 Stone et al. ..... 229/101
5,743,462 A 4/1998 Stone ..... 229/227
5,775,576 A 7/1998 Stone ..... 229/225
5,839,649 A * 11/1998 Clark ..... 229/120.18
6,012,630 A * 1/2000 Block ..... 229/120.18

* cited by examiner

CONTAINER FOR HOLDING AND DISPENSING MULTIPLE TYPES OF ITEMS

FIELD OF THE INVENTION

The present invention relates generally to packaging and more specifically relates to a container for holding and dispensing several types of objects in an easy-to-use configuration.

BACKGROUND OF THE INVENTION

The manufacturers, packagers, shippers, and consumers are constantly looking for more convenient ways of packaging and dispensing goods. The ideal container has a combination of: a) easy construction and filling of the container by a manufacturer or packager; b) compact size and shape for distribution; and c) convenience for the end consumer.

The shipment of consumer items, such as batteries, that come in several different styles with different uses poses a packaging problem. Namely, specialized packages have been developed for each style of item. This adds to the complexity and cost of packaging the items because materials have to be duplicated for each separate type of item. Further, there is some frustration for the consumer, who must purchase, store, and dispense the several types of items from separate containers.

It is desirable to have a container that is easy to build, fill, and dispense from. Ideally, such a container would further be compact in comparison to the items contained, to reduce shipping costs. It is also desirable to provide a container whose contents are easily dispensed by a consumer.

SUMMARY OF THE INVENTION

According to one embodiment of the present invention, a container is provided with separate compartments for holding different types of items.

According to another embodiment of the present invention, a container is provided with separate types of openings in connection with separate compartments, with each of the compartments and openings tailored to a specific type of item.

According to another embodiment of the present invention, an easy-to-assemble container enables simple filling of the container and easy access to multiple types of container contents through access areas that are customized for the separate item types.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
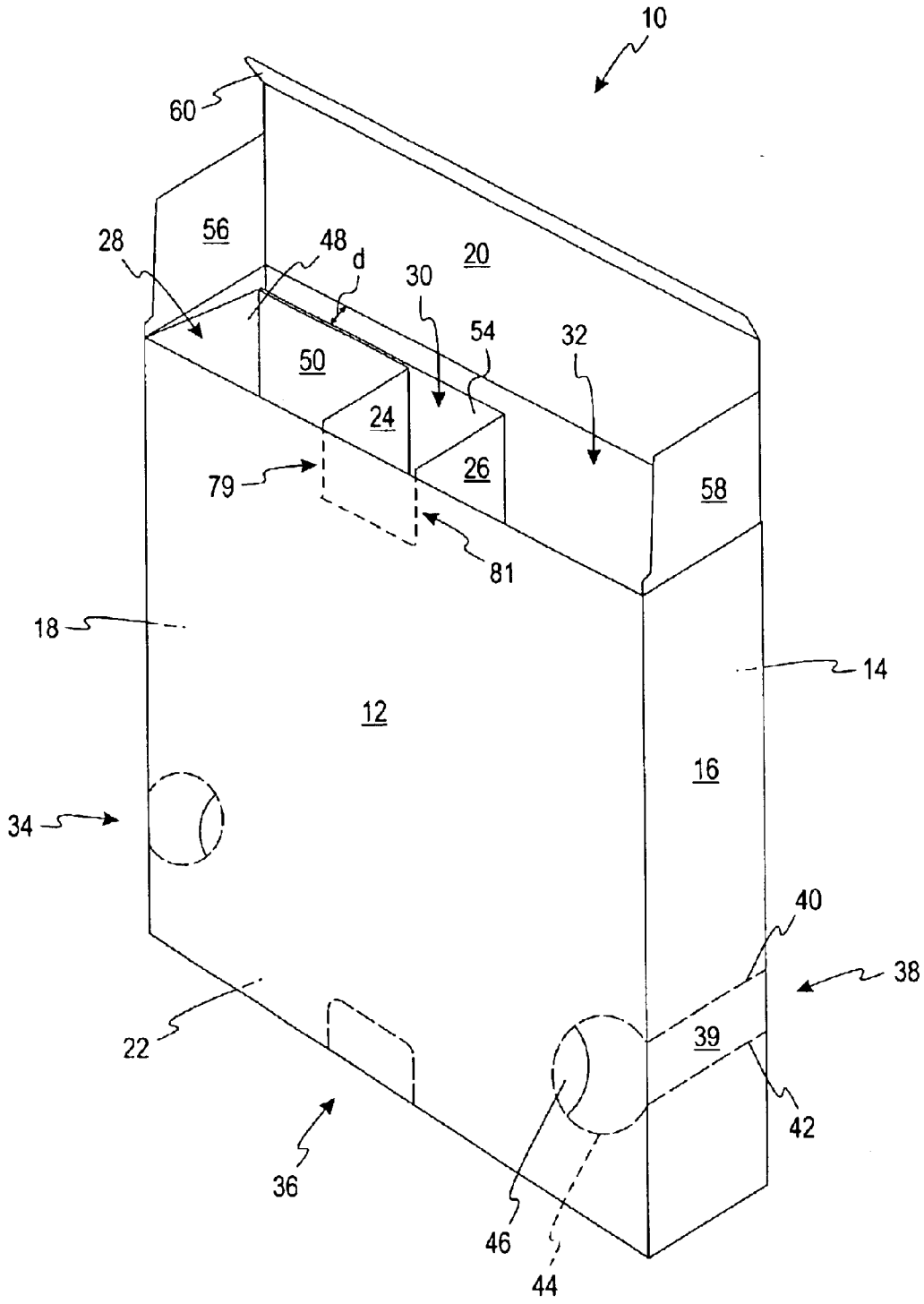
FIG. 1 is an isometric view of a container according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

An ideal package design achieves the goals of ease of construction and filling, convenience of shipment, and ease-of-use for an end-user or customer. FIG. 1 shows a container 10 that achieves these and other goals. The container 10 includes front and back panels 12 and 14, first and second side panels 16 and 18, and top and bottom panels 20 and 22. The container 10 further includes first and second dividing walls 24 and 26 which divide the container 10 into first, second, and third compartments 28, 30, and 32. The compartments 28, 30, and 32 may be custom-sized for particular types of items.

According to one embodiment of the present invention, the compartments 28, 30, and 32 are custom-sized for different types of batteries. For example, compartment 28 may be sized for C-cell batteries, compartment 30 may be sized for 9-volt batteries, and compartment 32 may be sized for D-cell batteries. It is to be understood, however, that the compartments 28, 30, and 32 may be sized differently for different types of consumer goods. For example, a container according to the present inventions may have compartments sized for different types of pens and pencils, erasers, storage media such as memory cards or film, cosmetics and personal items such as lip balm, or other types of consumer goods.

To enable access to the contents of a container according to the present invention, the container may be provided with a number of access areas. The container 10 shown in FIG. 1 includes first, second, and third access areas 34, 36, and 38. Each of the access areas includes a cover portion attached along a perforated line to the body of the container 10. For example, the third access area 38 includes a third tear-away cover 39 bounded by approximately parallel perforated lines 40 and 42 in the first side panel 16, extending toward the front panel 12 into an arc-shaped perforation 44. A width of the third access area 38 is narrower than a diameter of objects contained within the third compartment, preventing the objects from unintentionally falling out of the compartment. An analogous arc-shaped perforation may be formed on the back panel 14. To enable easy removal of the cover 39, the cover may be provided with a cutout area 46, so that a user's finger or another object can be used to easily remove the cover 39.

The first and second dividing walls 24 and 26 may be constructed as part of an internal folded and perforated flap, forming an internal flap-and-wall construction. In this embodiment, the internal folded and perforated flap may include a first transverse flap 48 hingedly connected to the front panel 12. The first transverse flap 48, in turn, is further hingedly connected to a first longitudinal flap 50, which abuts a portion of a third longitudinal flap 54. The first dividing wall 24, in turn, is hingedly connected to one edge of the first longitudinal flap 50 in a direction approximately perpendicular to the back panel 14. The opposing edge of the first dividing wall 24 is hingedly connected to a second longitudinal flap 52 (not seen in FIG. 1 due to perspective) which abuts a portion of the front panel 12. Continuing on, the next edge of the second longitudinal flap 52 is hingedly connected to the second dividing wall 26, whose opposing edge in turn is hingedly connected to a third longitudinal flap 54. The third longitudinal flap 54 may be the final flap of an internal flap-and-wall structure, turning backward toward the second side panel 18. The hinged connections of the internal flap-and-wall construction may be fold lines, score lines, perforation lines, or a combination of these.

The first transverse flap 48 may be provided with a width narrower than a width of the first and second side panels 16 and 18, such that a space having a distance "d" as shown in FIG. 1 is left between the first and third longitudinal flaps 50 and 54 and the back panel 14, thereby assuring that the first and second compartments 28 and 30 are appropriately sized to hold their contents and not bound to the width of the third compartment 32.

To close the container 10 for shipping and consumer use, first and second top minor flaps 56 and 58 are folded inwardly and the top panel 20 is folded inwardly so that an insertion flap 60 is inserted into the top of the container 10. The internal flap-and-wall construction may be provided with cutaway portions to accommodate the insertion flap 60 and hold the insertion flap 60 in a closed position.

Figure 2:
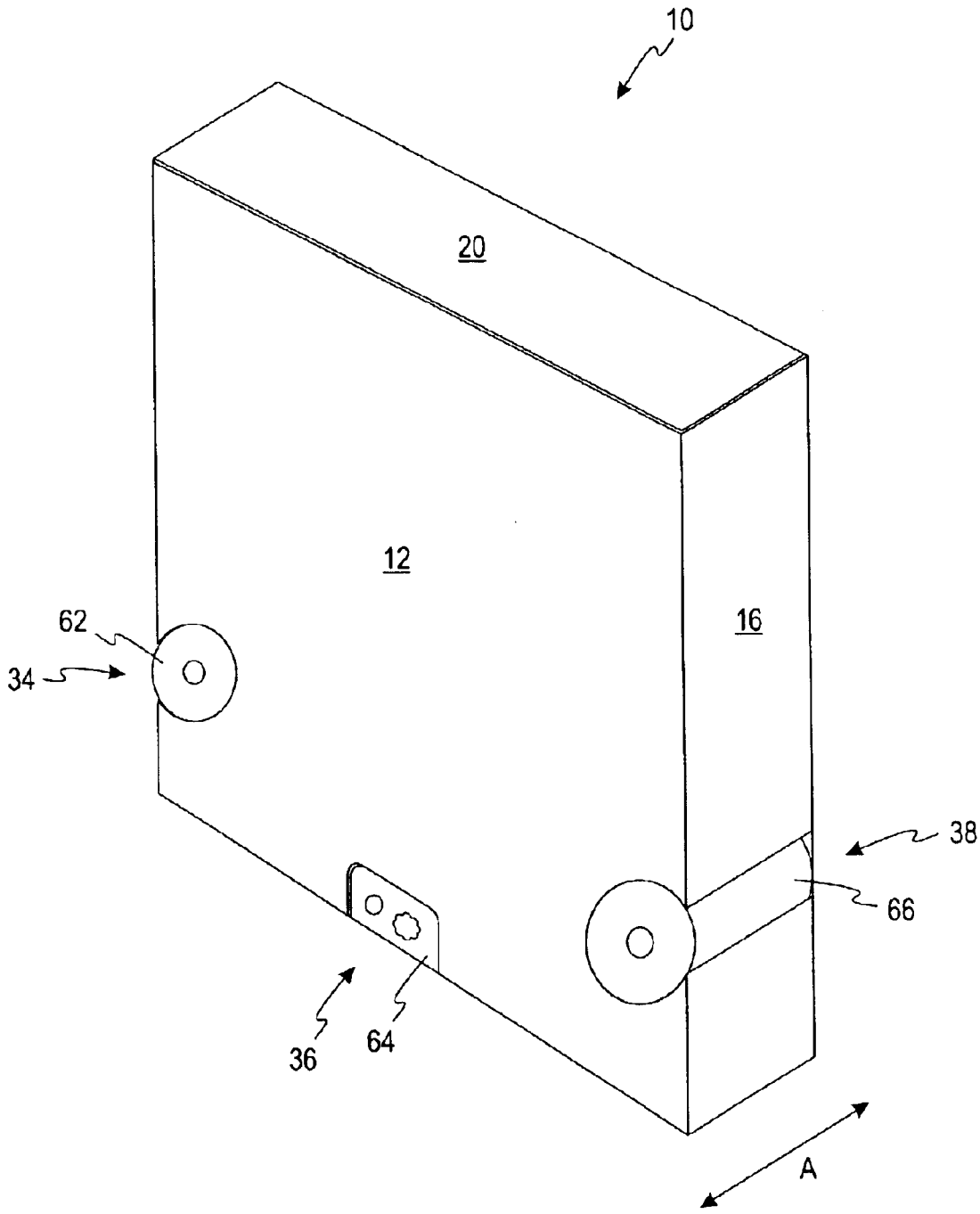
FIG. 2 is an isometric view of a container according to one embodiment of the present invention.

Turning now to FIG. 2, the container 10 is shown with the top panel 20 in its closed position and with the access areas 34, 36, and 38 open for dispensing items from the container. The carton 10 shown in the embodiment of FIG. 2 is adapted to contain and dispense three types of batteries. In particular, FIG. 2 shows that C-cell batteries 56 are available at the first access opening 34, 9-Volt batteries 58 are available at the second access opening 36, and D-cell batteries 60 are available at the third access opening 38. It is to be understood that the access openings of a container according to the present invention may be alternatively sized and positioned such that they are adapted to dispense alternative styles of batteries, or to dispense objects other than batteries. With the access openings opened as shown in FIG. 2, the contents of the container 10 may be easily removed via the access openings by sliding the contents in either direction of the two-sided arrow "A."

Figure 3:
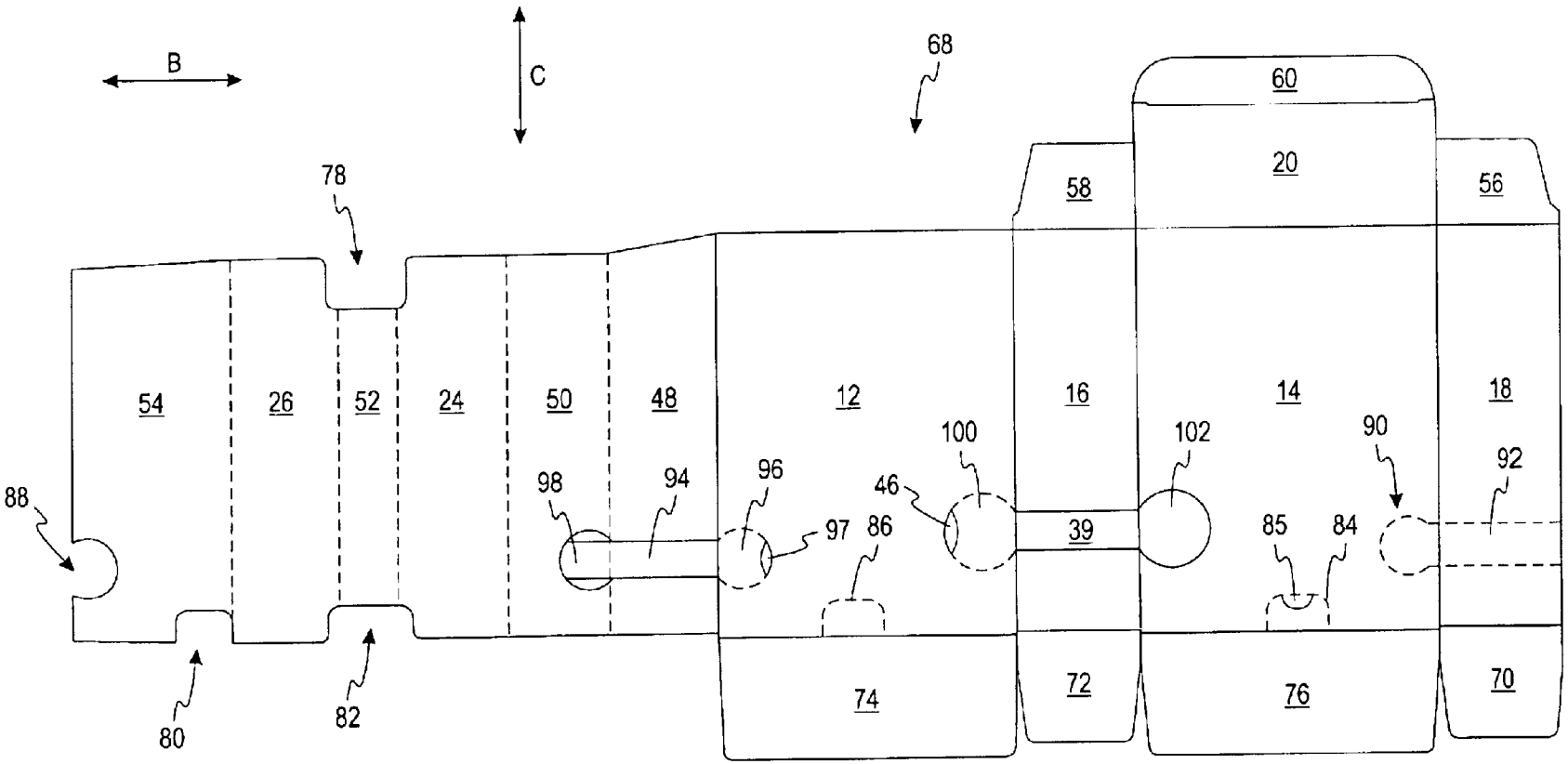
FIG. 3 is a plan view of a blank for constructing a container according to one embodiment of the present invention.

Turning now to FIG. 3, a blank for the construction of a container according to the present invention is shown. A container 10 according to the present invention may be constructed from a unitary blank 68 consisting of segments that are folded to form the container. To construct the container 10, the second side panel 18 is folded downwardly (away from the viewer) to a position approximately perpendicular to the back panel 14. The first transverse flap 48 is also folded downwardly to a position approximately perpendicular to the front panel 12. The first longitudinal flap 50 is then folded inwardly to a position approximately perpendicular to the first transverse flap 48, and the first dividing wall 24 is folded inwardly to a position approximately perpendicular to the first longitudinal flap 50. This forms the first compartment 28. The second longitudinal flap 52 is folded outwardly with respect to the first compartment, and the second dividing wall 26 is folded inwardly to a position approximately parallel to the first dividing wall 24. This forms the second compartment 30 of the finished container 10. Next, the third longitudinal flap 54 is folded inwardly to a position partially overlapping the first longitudinal flap 50, forming a rear panel for the second compartment 30. During this folding, the second longitudinal flap 52 may be connected to the inner side of the front panel 12, and the third longitudinal flap may be connected to the rear side of the first longitudinal flap 50 to form a unitary dividing structure.

The front panel 12 is then folded inwardly toward the second side panel 18 to a position approximately parallel to the back panel 14, such that the outer side of the first transverse flap 48 abuts the inner side of the second side panel 18. The first transverse flap 48 and the second side panel 18 may be connected at this point. First and second bottom minor flaps 70 and 72 are folded inwardly, a first bottom major flap 74 is folded inwardly to cover the bottom of the container 10, and a second bottom major flap 76 is folded inwardly over the inner bottom major flap 74, and connected thereto. Connections between flaps according to the present invention may be made using adhesive, staples, or other connection types known in the container art.

When the blank 68 is folded as described, a top cutaway portion 78 is disposed within the container to receive the insertion flap 60 in first and second notches 79 and 81 (shown in FIG. 1) provided respectively between upper portions of the first dividing wall 24 and the front panel 12 and the second dividing wall 26 and the front panel 12 when the second longitudinal flap 52 is placed adjacent the front panel 12. First and second bottom cutaway portions 80 and 82 align, respectively, with back and front second dispenser tear-away covers 84 and 86 to enable dispensing of items from the second compartment 30. The back second dispenser tear-away cover 84 may be provided with a back cover cut-out 85 to allow easy removal of the back second dispenser tear-away cover 84.

A side cutaway portion 88 aligns with a round back cover portion 90 of an outer first tear-away cover 92. The inner first tear-away cover 94 likewise aligns with both: a) the outer first tear-away cover 92, and b) a front round portion 96 of the first tear-away cover 92 disposed on the front panel 12 to allow removal of items from the first access area 34. The front round portion 96 may be provided with a cutout area 97 to allow easy access to the first access area 34. A back inner tear-away portion 98 aligns from the inside with both the side cutaway portion 88 and the round back cover portion 90 of the outer first tear-away cover 92. As shown in FIG. 3, the third tear-away cover 39 includes a front side round portion 100 and a back side round portion 102 to allow removal of items from the third access area.

A container according to the present invention may be constructed of a variety of materials. Corrugated paperboard is one preferred material for container construction, with either vertical or horizontal fluting being possible. Other materials for manufacture include paperboard, corrugated cardboard, corrugated or uncorrugated plastic sheeting, foam materials, and other packaging materials. According to one embodiment of the present invention, the blank 68 is constructed of corrugated paperboard, with corrugations running in the direction shown by arrow "B." Alternatively, a blank according to the present invention may be constructed with corrugations running in the direction shown by arrow "C" of FIG. 3. Further, alternative blanks may be provided with more transverse and longitudinal flaps for separating the container into more compartments, as may be desirable in certain applications of a container 10.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container for holding and dispensing multiple types of items comprising:

a first compartment adapted to contain a first item type, said first compartment having a first access area disposed toward a lower end of the first compartment, said first access area being covered by a first tear-away cover;

a second compartment adapted to contain a second item type, said second compartment having a second access area disposed at a bottom end of the second compartment, a front of said second compartment being covered by a front second tear-away cover; and a third compartment adapted to contain a third item type, said third compartment having a third access area disposed at a bottom end of the third compartment, said third access area being covered by a third tear-away cover.

2. The container of claim 1 wherein said first access area comprises a side access area and front and back round access areas, said side access area having a width narrower than a diameter of items contained within the first compartment.

3. The container of claim 1 wherein said third access area comprises a side access area bounded by front and back round access areas, said side access area having a width narrower than a diameter of items contained within the third compartment.

4. The container of claim 1 wherein said second access area comprises a front tear-away cover, a rear tear-away cover aligned with the front tear-away cover, and a base for supporting items contained within the second compartment.

5. The container of claim 1 wherein said first compartment is separated from said second compartment by a first dividing wall and said second compartment is separated from said third compartment by a second dividing wall.

6. The container of claim 1 wherein said first compartment is bounded by a transverse flap, a front panel, a first longitudinal panel, and a first dividing wall; said second compartment is bounded by said first dividing wall, a second longitudinal panel, a second dividing wall, and a third longitudinal panel, and said third compartment is bounded by said second dividing wall, said front panel, a side panel, and a back panel.

7. A container for holding and dispensing different types of items, said container comprising:

a front panel;

a first side panel;

a back panel;

a second side panel;

a top panel;

a bottom panel;

a first compartment defined by said front panel, a first transverse flap approximately perpendicular to said front panel, a first longitudinal flap approximately perpendicular to said first transverse flap, and a first dividing wall approximately perpendicular to said first longitudinal flap;

a second compartment defined by said first dividing wall, a second longitudinal flap approximately perpendicular to said first dividing wall, a second dividing wall approximately perpendicular to said second longitudinal flap, and a third longitudinal flap approximately perpendicular to said second dividing wall; and a third compartment defined by said second dividing wall, a portion of said front panel, said first side panel, and a portion of said back panel;

each of said first, second, and third compartments being sized to hold and dispense items of sizes particular to each compartment.

8. The container of claim 7 wherein said first compartment is provided with a first access area near a lower end thereof, said first access area comprising a side access area and front and back access areas, said first access area being covered by a first tear-away cover including an outer first tear-away cover and an inner first tear-away cover which are both removable with one pull.

9. The container of claim 8 wherein said second compartment is provided with a second access area at a bottom thereof, said second access area comprising a front tear-away cover, a rear tear-away cover aligned with the front tear-away cover, and a base for supporting items contained within the second compartment.

10. The container of claim 9 wherein said third compartment is provided with a third access area toward a lower end thereof, said third access area comprising a side access area and front and back access areas, said third compartment being covered by a third tear-away cover.

11. The container of claim 7 further comprising an insertion flap hingedly connected to said top panel and adapted to insert into a first notch provided between said first dividing wall and said front panel and into a second notch provided between said second dividing wall and said front panel.

12. A blank for forming a container for holding multiple types of items comprising:

a back panel segment;

a first side panel segment hingedly connected to said back panel segment;

a second side panel segment hingedly connected to said back panel segment opposite said first side panel segment;

a front panel segment hingedly connected to said first side panel segment opposite said back panel segment;

a first transverse flap segment hingedly connected to said front panel segment opposite said first side panel segment;

a first longitudinal flap segment hingedly connected to said first transverse flap segment opposite said front panel segment;

a first dividing wall segment hingedly connected to said first longitudinal flap segment opposite said first transverse flap segment;

a second longitudinal flap segment hingedly connected to said first dividing wall segment opposite said first longitudinal flap segment;

a second dividing wall segment hingedly connected to said second longitudinal flap segment opposite said first dividing wall segment;

a third longitudinal flap segment hingedly connected to said second dividing wall segment opposite said second longitudinal flap segment;

a first bottom major flap segment hingedly connected to said front panel segment along a bottom edge thereof;

a second bottom major flap segment hingedly connected to said back panel segment along a bottom edge thereof;

an outer first tear-away cover disposed in said second side panel segment; and an inner first tear-away cover disposed in said first transverse flap segment.

13. The blank of claim 12 further comprising:

a top panel segment hingedly connected along a top edge of said back panel segment.

14. The blank of claim 12 further comprising:

a top cutaway portion along a top edge of said second longitudinal flap.

15. The blank of claim 12 further comprising:

a back dispenser tear-away cover provided in said back panel segment along said bottom edge of said back panel segment; and a front dispenser tear-away cover provided in said front panel segment along said bottom edge of said front panel segment.

16. The blank of claim 15 further comprising a first bottom cutaway portion along a bottom edge of said third longitudinal flap and a second bottom cutaway portion along a bottom edge of said second longitudinal flap.

17. A method of forming a container for holding multiple types of objects comprising:

providing a blank comprising:

a back panel segment;

a first side panel segment hingedly connected to said back panel segment;

a second side panel segment hingedly connected to said back panel segment opposite said first side panel segment;

a front panel segment hingedly connected to said first side panel segment opposite said back panel segment;

a first transverse flap segment hingedly connected to said front panel segment opposite said first side panel segment;

a first longitudinal flap segment hingedly connected to said first transverse flap segment opposite said front panel segment;

a first dividing wall segment hingedly connected to said first longitudinal flap segment opposite said first transverse flap segment;

a second longitudinal flap segment hingedly connected to said first dividing wall segment opposite said first longitudinal flap segment;

a second dividing wall segment hingedly connected to said second longitudinal flap segment opposite said first dividing wall segment;

a third longitudinal flap segment hingedly connected to said second dividing wall segment opposite said second longitudinal flap segment;

a first bottom major flap segment hingedly connected to said front panel segment along a bottom edge thereof;

a second bottom major flap segment hingedly connected to said back panel segment along a bottom edge thereof;

an outer first tear-away cover disposed in said second side panel segment; and an inner first tear-away cover disposed in said first transverse flap segment folding said second side panel segment downwardly to a position approximately perpendicular to said back panel segment;

folding said first transverse flap segment downwardly to a position approximately perpendicular to said front panel segment;

folding said first longitudinal flap segment inwardly to a position approximately perpendicular to said first transverse flap segment folding said first dividing wall segment inwardly into a position approximately perpendicular to the first longitudinal flap segment to form a first compartment;

folding said second longitudinal flap segment outwardly with respect to said first compartment;

folding said second dividing wall segment inwardly to a position approximately parallel to said first dividing wall segment to form a second compartment;

folding said third longitudinal flap segment inwardly to a position partially overlapping said first longitudinal flap to form a rear panel of said second compartment;

folding said front panel segment inwardly toward said second panel segment to a position approximately parallel to said back panel segment; and folding said first bottom major flap segment inwardly to cover a bottom of said container; and folding said second bottom major flap segment inwardly to cover said bottom of said container.

18. The method of claim 17 further comprising connecting said second longitudinal flap segment to an inner side of said front panel segment.

19. The method of claim 17 further comprising connecting said third longitudinal flap segment to a rear side of said first longitudinal flap segment.

20. The method of claim 17 further comprising connecting said first transverse flap segment to said second side panel segment.

* * * * *